US005990849A

United States Patent [19]

Salvail et al.

[11] Patent Number: 5,990,849

[45] Date of Patent: Nov. 23, 1999

[54] COMPACT SPIRAL ANTENNA

[75] Inventors: Gary Salvail, Tucson; Michael S. Mehen, Vale; I-Ping Yu, Tucson, all of Ariz.

[73] Assignee: Raytheon Company, Lexington, Mass.

[21] Appl. No.: 09/054,889

[22] Filed: Apr. 3, 1998

[51] Int. Cl.[6] ..... H01Q 1/36

[52] U.S. Cl. ..... 343/895; 343/729; 343/846

[58] Field of Search ..... 343/895, 846, 343/729, 728; H01Q 1/36

[56] References Cited

U.S. PATENT DOCUMENTS 4,095,230 6/1978 Salmond et al. ..... 343/729

4,598,276 7/1986 Tait ..... 343/895

*Primary Examiner*—Hoanganh Le

*Assistant Examiner*—Kimnhung Nguyen

*Attorney, Agent, or Firm*—David W. Collins; Andrew J. Rudd; Glenn H. Lenzen

[57] ABSTRACT

An antenna is provided that receives electromagnetic radiation and includes a dielectric substrate (106). First and second spirals (60 and 70) on a first surface of the substrate (106) radiate the electromagnetic radiation. A third spiral (80) is utilized on a second surface of the substrate (106) and is substantially underneath one of the first and second spiras(60 and 70). The resulting spiral antenna is compact and has multioctave bandwidth capability.

19 Claims, 2 Drawing Sheets

COMPACT SPIRAL ANTENNA

TECHNICAL FIELD OF THE INVENTION

This invention relates to the field of antennas, and more particularly to compact antennas.

BACKGROUND OF THE INVENTION

Past approaches for antenna design include spirals that are not sufficiently compact since their absorber cavities have generally been on the magnitude of a quarter wavelength deep. For example, an antenna with frequency of 10 GHz which has a wavelength of approximately one inch requires a cavity of at least a quarter inch in depth. Since this past approach matches the cavity's depth to that of the longest wavelength, it is not suitable for broadband operations.

Other past approaches f or compact antennas include utilizing patch antennas. Patch antennas are relatively thin and can be on the order of 2% of lambda (i.e., wavelength) in thickness. However, patch antennas are limited in bandwidth and are too large for certain applications where space is considered a premium. Moreover, patch antennas cannot be dedicated to multioctave bandwidths.

Still another previous approach is the multioctave bandwidth spiral-mode microstrip (SMM) antenna. However, this approach necessitates the use of a large ground plane that extends past the diameter of the spiral arms of the antenna in order to operate. This large ground plane increases the overall size of the antenna which may not be suitable for applications that demand a relatively small antenna. Moreover, the SMM antenna approach can only provide a single common ground plane for a dual or multiple concentric antenna configuration. This greatly limits isolation between the antennas.

Accordingly, there is a need for a compact spiral antenna that has multioctave bandwidth capability that allows isolation between concentric spirals.

SUMMARY OF THE INVENTION

In accordance with the teachings of the present invention, an antenna is provided that receives electromagnetic radiation and includes a dielectric substrate. First and second spirals on a first surface of the substrate radiate the electromagnetic radiation. A third spiral is utilized on a second surface of the substrate and is substantially underneath one of the first and second spirals.

Additional advantages and features of the present invention will become apparent from the subsequent description and the appended claims, taken in conjunction with the accompanying drawings in which:

DETAILED DESCRIPTION OF THE PREFERRED EMBODIMENT

Figure 1:
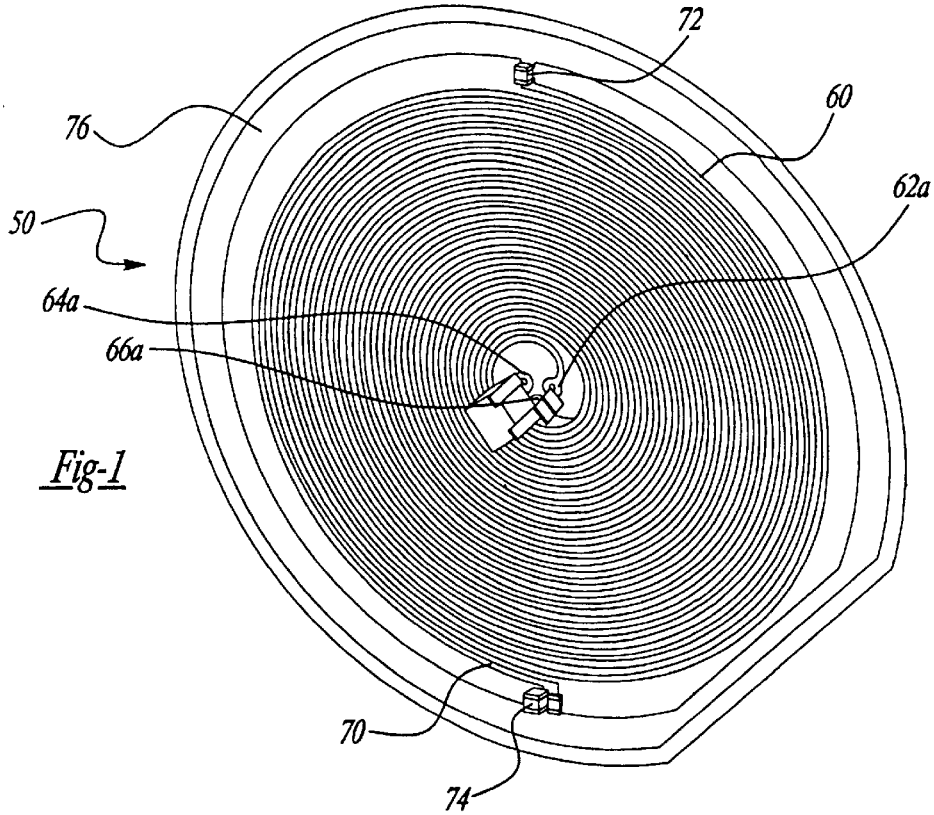
FIG. 1 is a top view of a spiral antenna embodying the invention.
Figure 2:
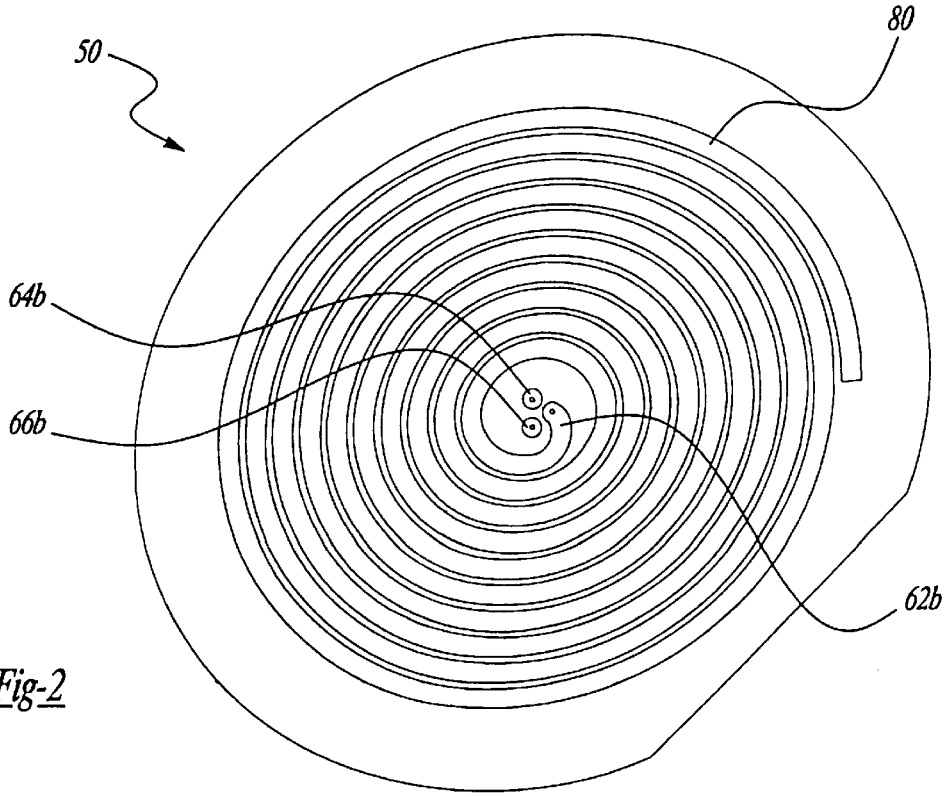
FIG. 2 illustrates a bottom view of the spiral antenna of FIG. 1.

FIGS. 1 and 2 illustrate an exemplary embodiment of a spiral antenna 50. Spiral antenna 50 includes conductive material on both sides of a dielectric substrate with first and second spirals (60 and 70 as shown in FIG. 1) etched on one surface and a single arm third spiral 80 etched on the opposite surface (as shown in FIG. 2). The dielectric substrate fills in the cavity formed between first/second spirals (60 and 70) and third spiral 80.

First and second spirals (60 and 70) are positioned so that first spiral 60 is directly over the conductor centerline of third spiral 80 while second spiral 70 is centered over the spiraling gap of third spiral 80. The first and second spirals (60 and 70) are concentric about each other and are disposed in a common plane.

Third spiral 80 preferably is of a greater width than the width of either first or second spiral (60 and 70). This greater width allows the winding arm of third spiral 80 to fit beneath the combined width of the winding arm of first spiral 60 and the gap between the first and second spirals (60 and 70). Another embodiment includes the width of the winding arm of third spiral 80 to fit beneath the combined width of the winding arm of second spiral 70 and the gap between the first and second spirals (60 and 70).

First and second spirals (60 and 70) are preferably 0.020 inches wide with a 0.020 inch gap between them. The leg width of third spiral 80 is 0.060 inches with a 0.02 inch gap between successive loops. These dimensions are optimal for 2 GHz and 3 GHz operations. The spacing and widths can be scaled for the frequency of interest. First and second spirals (60 and 70) are separated from third spiral 80 by the dielectric substrate thickness. Preferably, the thickness of the dielectric substrate is 0.003 inches or less (thickness values of 0.001, 0.002 and 0.003 inches can also be used). Thicker values significantly reduce the bandwidths.

Due to the novel approach of the present invention, the cavity of the spiral legs is approximately 3–5% of the wavelength. Consequently, when the various elements of the antenna 50 are assembled together, the result is a compact spiral antenna which has multioctave bandwidth capability. Moreover, it allows isolation between concentric spirals.

The third spiral 80 was conductively connected by way of a first pad 62*a* with a via to either a second or third pad (64*a* and 66*a*) on the same surface as first and second spirals (60 and 70).

Tuning to reduce axial ratio is accomplished by placing a capacitor or inductor between the pads (62*a*, 64*a*, and 66*a*) and the ground plane pads (62*b*, 64*b*, and 66*b*). The ends (72 and 74) of the spiral legs are terminated with resistors and may also be terminated with either an inductor in series or a capacitor in parallel with the resistors. A grounding annulus 76 is provided around the spirals for attaching the terminating components.

Figure 3:
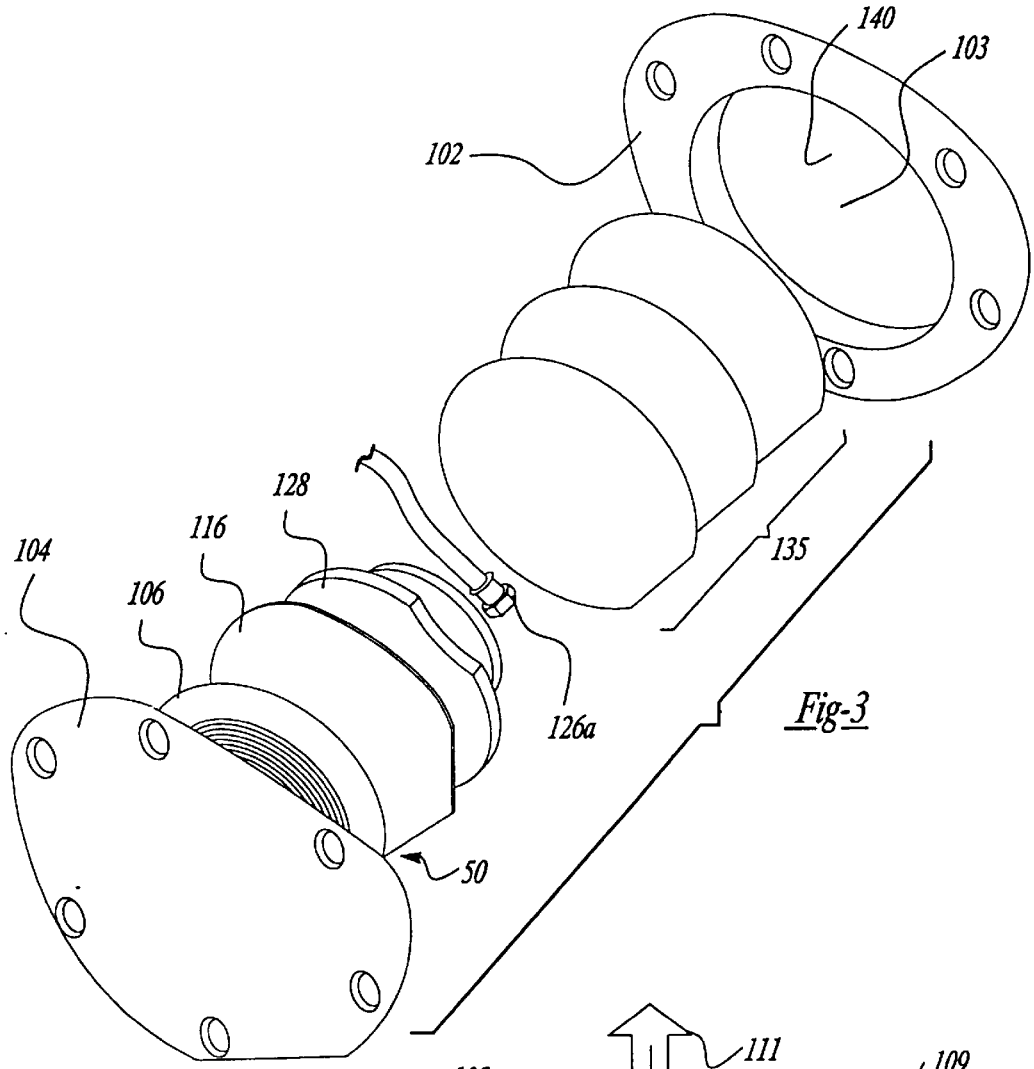
FIG. 3 is an exploded isometric view of an exemplary implementation of a multi-band spiral antenna embodying the invention.
Figure 4:
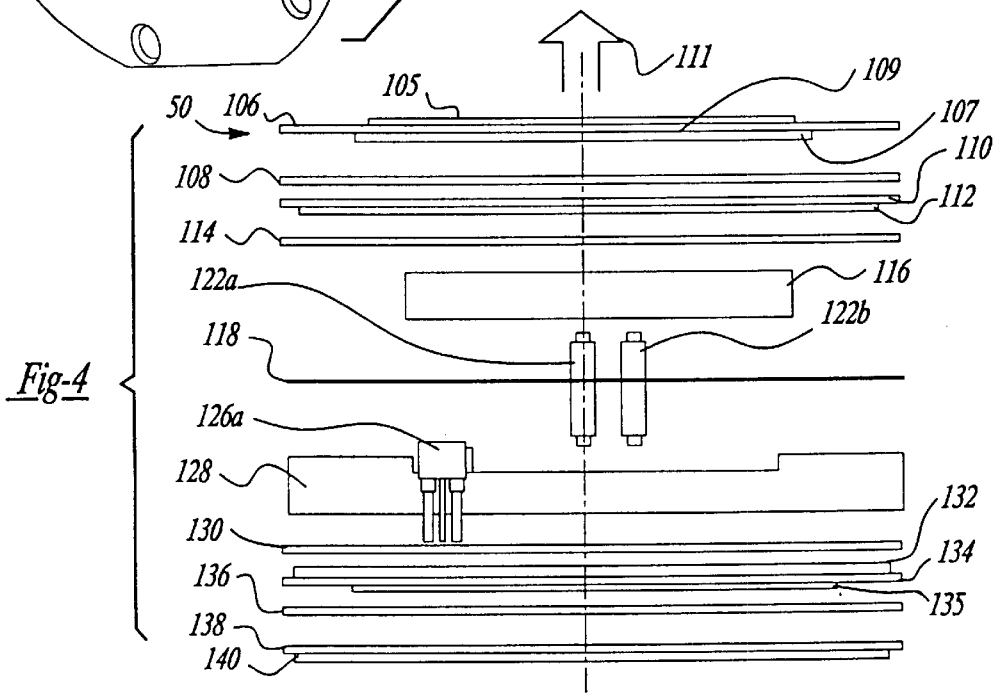
FIG. 4 is a side exploded view of the antenna of FIG. 3.

FIGS. 3 and 4 illustrate an exemplary implementation of spiral antenna 50 which embodies the invention. The spiral antenna 50 employs filters to pass the band of one spiral and reject the band of other spirals. When isolation is not required, the filter is omitted.

FIG. 3 is an exploded isometric view of the antenna elements, which are sandwiched between an antenna housing structure 102 and a radome 104. Within the antenna housing structure 102 is cavity 103 and ground plane 140. FIG. 4 is a side exploded view of the elements of FIG. 3.

With reference to FIG. 4, spirals 60, 70 and 80 are defined as copper conductor patterns etched from a copper layer on a dielectric substrate 106. First and second spirals (60 and 70) exist in plane 105, and third spiral 80 exists in plane 107. Third spiral 80 notably is used to control the electric field within antenna 50 and to direct the energy away from antenna 50 in the direction designated by arrow 111.

In this embodiment, substrate 106 is bonded by bonding film 108 to an exposed surface of another dielectric substrate 110. A ground ring 112 is defined on the opposite surface of the substrate 110.

A circular slab of foam 116 is bonded to ground ring 112 by bonding film 114. Surrounding slab 116 is a isolation ring 120. A surface of a dielectric absorber slab structure 128 is bonded to the foam 116 by bonding film 118. The opposite surface of the absorber 128 is bonded by bonding film 130 to a ground plane 132 defined on a surface of substrate 134. The balun and filter circuits 135 are defined on the opposite surface of the substrate 134. An exposed surface of a dielectric substrate 138 is bonded to the surface of the circuits 135 by bonding film 136. Another ground plane 140 is defined on the opposite side of the substrate 138.

More filters and baluns can be added if more spirals are needed for multiple frequency bands.

The substrate material that exists between planes 105 and 107 of spiral antenna 50 is a low dielectric material. The low dielectric material in the preferred embodiment includes polyflon from one to three mil thickness which is available from such sources as the Polyflon company.

The next layer is a higher dielectric to increase the phase delay of any energy passing to the ground plane 140. A dielectric constant of approximately thirty was used. This is backed by a conductive surface which forms the reflective bottom of the cavity. The short coaxial feeds from the baluns traverse the two intermediate layers to reach the two spirals on the surface where they are attached.

Exemplary coaxial cable and termination resistor circuits (122*a* and 122*b*) are illustrated, for connection between termination pads connected to spiral arms on plane 105 and the ground plane 140.

Element 126*a* illustrates a coaxial feed connector for connection to the filter/balun circuits 135. Connector 126*a* is for feeding spiral antenna 50.

It will be appreciated by those skilled in the art that various changes and modifications may be made to the embodiments discussed in the specification without departing from the spirit and scope of the invention as defined by the appended claims.

What is claimed is:

1. A multiple frequency band antenna for receiving electromagnetic radiation signals, comprising:

a dielectric substrate;

first and second spirals on a first surface of said substrate for radiating said electromagnetic radiation signals; and a third spiral on a second surface of said substrate, said third spiral being substantially underneath one of said first and second spirals so as to at least partially cover at least one of said first and second spirals.

2. The antenna of claim 1 wherein said antenna operates at a predetermined wavelength, said first, second and third spirals defining the height above a ground plane, wherein the height above said ground plane is less than 15 percent of said predetermined wavelength.

3. The antenna of claim 2 wherein said antenna operates at a predetermined wavelength, said first, second and third spirals defining the height above a ground plane, wherein the height above said ground plane is less than 6 percent of said predetermined wavelength.

4. The antenna of claim 1 wherein said antenna operates at a predetermined wavelenght, said first, second and third spirals being disposed in a cavity of said antenna, said first, second and third spirals defining the height of said cavity, wherein the height of said cavity is less than 15 percent of said predetermined wavelength.

5. The antenna of claim 1 wherein said antenna operates at a predetermined wavelength, said first, second and third spirals being disposed in a cavity of said antenna, said first, second and third spirals defining the height of said cavity, wherein the height of said cavity is less than 6 percent of said predetermined wavelength.

6. The antenna of claim 1 wherein said third spiral has a conductor centerline, wherein said first and second spirals are positioned so that said first spiral is substantially positioned over the conductor centerline of said third spiral.

7. The antenna of claim 6 wherein said third spiral includes a spiraling gap, said second spiral is substantially positioned over the spiraling gap in said third spiral.

8. The antenna of claim 7 wherein the width of said first and second spirals substantially matches the width of said spiraling gap of said third spiral.

9. The antenna of claim 1 wherein said first and second spirals are concentric about each other and are disposed in a common plane.

10. The antenna of claim 1 wherein said spirals contain copper conductor patterns etched from a copper layer on said substrate.

11. The antenna of claim 1 further comprising:

a balun and filter circuit connected to said first and second spirals for removing a predetermined frequency from said electromagnetic radiation signals.

12. The antenna of claim 1 further comprising:

a capacitor connected to said spirals for performing tuning.

13. The antenna of claim 1 further comprising:

an inductor connected to said spirals for performing tuning.

14. A multiple frequency band antenna for receiving electromagnetic radiation signals, comprising:

a dielectric substrate;

first and second spirals on a first surface of said substrate for radiating said electromagnetic radiation signals; and a third spiral on a second surface of said substrate, said third spiral being substantially underneath one of said first and second spirals, said third spiral having a conductor centerline, said first and second spirals being positioned so that said first spiral is substantially positioned over the conductor centerline of said third spiral so as to at least partially cover said third spiral;

said antenna operating at a predetermined wavelength, said first, second and third spirals defining the height above a ground plane, wherein the height above said ground plane is less than 15 percent of said predetermined wavelength.

15. The antenna of claim 14 wherein said antenna operates at a predetermined wavelength, said first, second and third spirals being disposed in a cavity of said antenna, said first, second and third spirals defining the height of said cavity, wherein the height of said cavity is less than 6 percent of said predetermined wavelength.

16. The antenna of claim 14 wherein said third spiral includes a spiraling gap, said second spiral is substantially positioned over the spiraling gap in said third spiral.

17. The antenna of claim 16 wherein the width of said first and second spirals substantially matches the width of said spiraling gap of said third spiral.

18. The antenna of claim 14 wherein said first and second spirals are concentric about each other and are disposed in a common plane.

19. The antenna of claim 14 further comprising:

a capacitor connected to said spirals for performing tuning.

* * * * *

UNITED STATES PATENT AND TRADEMARK OFFICE

CERTIFICATE OF CORRECTION

PATENT NO. : 5,990,849
APPLICATION NO. : 09/054889
DATED : November 23, 1999
INVENTOR(S) : Gary Salvail et al.

It is certified that error appears in the above-identified patent and that said Letters Patent is hereby corrected as shown below:

On page 1, above the TECHNICAL FIELD OF THE INVENTION paragraph, please insert the following paragraph:

--STATEMENT REGARDING FEDERALLY SPONSORED RESEARCH OR DEVELOPMENT
This invention was made with Government support under N00024-95-C-5400 awarded by The Department of the Navy. The Government has certain rights in this invention.--

Signed and Sealed this
Twenty-fourth Day of April, 2012

David J. Kappos

David J. Kappos
*Director of the United States Patent and Trademark Office*